US006542704B2

(12) United States Patent
Suetsugu

(10) Patent No.: US 6,542,704 B2
(45) Date of Patent: Apr. 1, 2003

(54) DEVICE AND METHOD FOR CONSTANTLY ADJUSTING THE CONCENTRATION AND FILLING LEVEL OF DEVELOPING SOLUTION IN A PRINTING PROCESS

(75) Inventor: Junichi Suetsugu, Tokyo (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/808,066

(22) Filed: Mar. 14, 2001

(65) Prior Publication Data

US 2001/0022901 A1 Sep. 20, 2001

(30) Foreign Application Priority Data

Mar. 16, 2000 (JP) ..... 2000-074785

(51) Int. Cl.[7] ..... G03G 15/10
(52) U.S. Cl. ..... 399/57; 399/58
(58) Field of Search ..... 399/57, 58, 61, 399/62

(56) References Cited

U.S. PATENT DOCUMENTS 5,926,668 A * 7/1999 Lee ..... 399/57
2001/0008585 A1 * 7/2001 Hagiwara ..... 399/57

FOREIGN PATENT DOCUMENTS

JP 11-184258 7/1999

* cited by examiner

*Primary Examiner*—Quana M. Grainger
(74) *Attorney, Agent, or Firm*—Ostrolenk, Faber, Gerb & Soffen, LLP

(57) ABSTRACT

A liquid developing device comprises a storage tank, a concentration sensor, a level sensor, a concentrated-ink supply pump, a carrier supply pump, an ink discharge pump, and a controller. The storage tank stores ink, including toner and carrier, for developing a photoconductor. The concentration sensor measures a concentration of ink to be supplied to the photoconductor. The level sensor measures the amount of ink stored in the storage tank. The concentrated-ink supply pump sends concentrated ink to the storage tank. The carrier supply pump sends carrier to the storage tank. The ink discharge pump discharges excessive ink from the storage tank. Based on measurement value and amount from the concentration tank and the level sensor, the controller controlls the concentrated-ink supply pump, the carrier supply pump, and the ink discharge pump, so that the concentration and amount of ink stored in the storage tank is retained at a predetermined level.

7 Claims, 6 Drawing Sheets

DEVICE AND METHOD FOR CONSTANTLY ADJUSTING THE CONCENTRATION AND FILLING LEVEL OF DEVELOPING SOLUTION IN A PRINTING PROCESS

BACKGROUND OF THE INVENTION

1. Field of the Invention

The present invention relates to a printing device and method including a liquid developing device, a liquid developing method and a related printer including the device, and more particularly, to a liquid developing device which can retain an ink concentration and ink amount for use during printing.

2. Description of the Related Art

A liquid developing device forms a developing unit included in a wet-type electrophotographic printer, such as a printer, copier, facsimile device, for example. The liquid developing device includes a storage tank which stores ink, which is a mixture of toner and carrier, and supplies a developing unit with the stored ink. The developing unit develops an electrostatic latent image formed on a photoconductor belt with the ink. The toner included in the ink is attracted onto the photoconductor belt by electric charge. The toner travels inside the carrier, is adhered onto the photoconductor belt, and forms a toner image corresponding to the electrostatic latent image. The toner image is transferred onto a paper so as to form a desired image thereon.

The ink which includes the toner remaining after being used for developing the image is collected into the storage tank. The collected ink mainly includes carrier, thus the concentration of the ink in the storage tank becomes low. The liquid developing device uses ink, whose concentration is 3% and volume is 400 ml, for example. In this case, if the liquid developing device successively prints a predetermined image onto 400 to 500 papers with printing density of 5%, the concentration of the ink becomes lower than 2%. Thus, the printing can not be properly accomplished. The concentration of ink indicates the weight percentage of toner included in the ink. The printing density indicates the percentage of an area occupied by an output image in the entire printing area on the paper.

Some carrier is adhered onto the photoconductor belt without being collected into the storage tank. This results in a decrease in the amount of ink inside the storage tank, hence failing in printing performance.

In this structure, hence, the liquid developing device needs to adjust the concentration and amount of the ink stored in the storage tank. Such a liquid developing device is disclosed in Unexamined Japanese Patent Application KOKAI Publication No. H11-184258. When the concentration of the ink stored in the storage tank is equal to or lower than a predetermined level, the liquid developing device discharges the stored ink, and adds concentrated ink and carrier, thereby to keep a predetermined amount of the ink stored in the storage tank.

While adjusting the concentration of the ink, the liquid developing device needs to suspend the printing operation. That is, the adjusting and the printing can not be performed at the same time. Hence, if the concentration of the ink gets lower while successively developing images onto a large number of papers, the liquid developing device adjusts the concentration during the suspension of the developing. Hence, the printing is achieved only with low efficiency.

Generally speaking, some colors of inks are more likely to be used. Thus, if the adjustment of the concentration is not successfully performed before the developing, an image is output with the frequently-used inks having insufficient concentration of toner. In consideration of this, if an arithmetic logic unit which can perform data processing speedily is employed in the liquid developing device, the problem is that the liquid developing device is manufactured at a high cost.

SUMMARY OF THE INVENTION

The present invention has been made in consideration of the above. It is accordingly an object of the present invention to provide a liquid developing device, adjusting a concentration and amount of ink while developing is still performed, a liquid developing device, and a printer including the device.

Another object thereof is to provide a liquid developing device, for reducing unevenness of toner colors at a low cost, a liquid developing device, and a printer including the device.

In order to achieve the above objects, according to the first aspect of the present invention, there is provided a liquid developing device comprising:

- a storage tank which stores an ink, including a toner and a carrier, for developing an electrostatic latent image on a photoconductor;
- an ink supply pump which sends an ink from the storage tank to the photoconductor;
- a concentration sensor which measures a toner concentration of the ink to be sent to the photoconductor;
- a storage-amount sensor which measures an amount of ink stored in the storage tank;
- a concentrated-ink supply pump which sends a concentrated ink from an ink cartridge for storing an concentrated ink to the storage tank;
- a carrier supply pump which sends a carrier from a carrier cartridge for storing a carrier to the storage tank;
- an ink discharge pump which discharges an excessive ink from the storage tank to a discharge cartridge; and
- a controller which controlls the concentrated-ink supply pump, the carrier supply pump, and the ink discharge pump, so as to retain a predetermined level of the toner concentration of the ink stored in the storage tank and a predetermined amount of the ink, based on a measurement value from the concentration sensor and a measurement amount from the storage-amount sensor.

According to the above structure, the ink supply pump sends the ink from the storage tank to the photoconductor. The concentrated-ink supply pump sends the concentrated ink to the storage tank. The carrier supply pump sends the carrier to the storage tank. The ink discharge pump discharges the excessive ink from the storage tank. In this structure, the liquid developing device can develop the photoconductor with the stored ink, and can retain the predetermined levels of the toner concentration and the amount of the stored ink. Therefore, the liquid developing device can successively print with ink whose toner concentration is stably controlled.

The controller may supplement the storage tank with a concentrated ink using the concentrated-ink supply pump, supplement the storage tank with a carrier using the carrier supply pump, and discharge an excessive ink from the storage tank using the ink discharge pump, based on an error between a measurement value from the concentration sensor and a predetermined value of the concentration and an error between a measurement amount from the storage-amount sensor and a predetermined amount, so that the toner concentration of the ink stored in the storage tank and the amount of the ink approach the predetermined value of the concentration and the predetermined amount, respectively.

In the above structure, the controller stores a controlling program, so as to perform PID (Proportional Integration and Derivation) controlling, proportional controlling, proportional integration controlling, etc. based on the error between the measurement value sent form the concentration sensor and the predetermined value (target value). The controller can control each of the concentrated-ink supply pump, the carrier supply pump, and the ink discharge pump, so as to approach the error between the measurement value and the predetermined value and the error between the measurement amount and the predetermined amount to 0, in accordance with the controlling program.

The controller may drive each of the concentrated-ink supply pump, the carrier supply pump, the ink discharge pump, so as to supply a concentrated ink or a carrier to the storage tank, in accordance with at least one of the error between the measurement value from the concentration sensor and the predetermined value of the toner concentration, an integrated result of the error, and a differentiated result of the error, and to supply a concentrated ink and a carrier to the storage tank or to discharge an excessive ink from the storage tank, in accordance with at least one of the error between the measurement amount from the level sensor and the predetermined amount, an integrated result of the error, and a differentiated result of the error.

The controller may:

determine whether the measurement value from the concentration sensor is lower than the predetermined value;

supplement the storage tank with a concentrated ink using the concentrated-ink supply pump, when determined that the measurement value from the concentration sensor is lower than the predetermined value, and supplement the storage tank with a carrier using the carrier supply pump, when determined that the measurement value from the concentration sensor is higher than the predetermined value;

determine whether the measurement amount from the storage-amount sensor is lower than the predetermined amount;

supplement the storage tank with a concentrated ink and a carrier using the concentrated-ink supply pump and the carrier supply pump, when determined that the measurement amount from the storage-amount sensor is lower than the predetermined amount, and discharge an excessive ink from the storage tank using the ink discharge pump, when determined that the measurement amount from the storage-amount sensor is higher than the predetermined amount.

In order to achieve the above objects, according to the second aspect of the present invention, there is provided a liquid developing device comprising:

four storage tanks which respectively store fours colors, yellow, cyan, magenta, and black, of inks, each including a toner and a carrier, for use in developing an electrostatic latent image formed on a photoconductor;

four ink supply pumps which respectively send the four colors of inks from the respective storage tanks;

four concentration sensors which respectively measure toner concentrations of the respective four colors of inks to be sent to the photoconductor;

four storage-amount sensors which respectively measure amounts of four colors of inks stored in the respective storage tanks;

four concentrated-ink supply pumps which respectively send four colors of inks from ink cartridges to the respective storage tanks each of which stores a same color of ink as a color of a concentrated ink stored in one of four ink cartridges;

a carrier supply pump which sends a carrier to the storage tanks from a carrier cartridge storing a carrier;

four ink discharge pumps which respectively discharge excessive inks from the respective storage tanks to a discharge cartridge; and a controller which controlls each of the concentrated-ink supply pumps, the carrier supply pump and the ink discharge pumps, so as to retain a predetermined level of the toner concentrations of the inks stored in the respective storage tanks and a predetermined amount of the inks stored therein, based on a measurement value form each of the concentration sensors and a measurement amount of each of the storage-amount sensors.

The controller may:

sequentially store measurement values measured by the respective concentration sensors and measurement amounts measured by the respective storage-amount sensors, and obtain a change rate of each of the respective measurement values and change rates of the respective measurement amounts, with respect to a predetermined time period;

discriminate an ink having a highest change rate among the change rates of other inks, based on combinations of the respective change rates of the toner concentrations and the respective change rates of the amounts of the inks which are stored in the respective storage tanks; and control the toner concentration of the discriminated ink and the amount of the discriminated ink.

According to the above structure, the controller discriminates an ink whose toner concentration and amount show a sudden change. The controller then can control the toner concentration and amount of the discriminated ink. Therefore, in the case of successively printing images with an ink, when the printing density of the ink is high, the unevenness of the color inks can be reduced.

In order to achieve the above objects, according to the third aspect of the present invention, there is provided a printer comprising:

the liquid developing device of claim 1;

a photoconductor which is rotated by being driven by a driving roller;

a charger which charges the photoconductor with electricity;

an exposure device exposes the charged photoconductor to form an electrostatic latent image on the photoconductor;

a developing unit to which an ink is supplied from the liquid developing device, and which adheres the supplied ink onto a section of the photoconductor which is charged with electricity and on which the electrostatic latent image is formed;

a transfer roller which is rotated in synchronization with the photoconductor, and onto whose surface a toner on the photoconductor is transferred so as to transfer the toner onto a recording medium;

a fixation roller which is rotated in contact with the transfer roller between which the recording medium is sandwiched, melts the toner transferred onto the transfer roller, and fixes the melted toner onto the recording medium; and a discharge roller which discharges the recording medium onto which the toner is fixed by the fixation roller.

In order to achieve the above objects, according to the fourth aspect of the present invention, there is provided a liquid developing method comprising:

supplying an ink from a storage tank, storing an ink including a toner and a carrier and for use in developing an electrostatic latent image formed on a photoconductor, to the photoconductor;

developing the photoconductor with the ink supplied by the supplying;

measuring a toner concentration of the ink which is to be sent to the photoconductor by the supplying;

measuring an amount of ink stored in the storage tank; and controlling the toner concentration of the ink stored in the storage tank and the amount of the ink, by supplying the storage tank with a concentrated ink and a carrier, and by discharging an excessive ink from the storage tank, while developing the photoconductor by the developing, based on a measurement value measured by the measuring the toner concentration and a measurement amount measured by the measuring the amount.

The controlling may include supplying a concentrated ink to the storage tank, supplying a carrier to the storage tank, and discharging an excessive ink from the storage tank, based on an error between the measurement value and a predetermined value of a toner concentration and an error between the measurement amount and a predetermined amount of ink, so as to approach the toner concentration of the ink stored in the storage tank and the amount of the stored ink to the predetermined value and the predetermined amount, respectively.

The controlling may include supplying a concentrated ink to the storage tank, supplying a carrier to the storage tank, and discharging an excessive ink from the storage tank, so as to supply the storage tank with an amount of an ink or carrier, in accordance with at least one of the error between the measurement value and the predetermined value of the toner concentration, an integrated result of the error, and a differentiated result of the error, and to supply to or discharge from the storage tank an amount of a liquid, in accordance with at least one of an error between the measurement amount and the predetermined amount of the ink, an integrated result of the error, and a differentiated result of the error.

The controlling may include:

determining whether the measurement value which is measured by the measuring the concentration is lower than a predetermined value;

supplying the storage tank with a concentrated ink, when determined that the measurement value is lower than the predetermined value;

supplying the storage tank with a carrier, when determined that the measurement value is higher than the predetermined value;

determining whether the measurement amount which is measured by the measuring the amount is higher than a predetermined amount;

discharging an excessive ink from the storage tank, when determined that the measurement amount is higher than the predetermined amount; and supplying the storage tank with a concentrated ink and a carrier, when determined that the measurement amount is lower than the predetermined amount.

In order to achieve the above objects, according to the fifth aspect of the present invention, there is provided a liquid developing method comprising:

supplying four kinds of inks, each of which includes a toner and a carrier, for use in developing an electrostatic latent image formed on a photoconductor, respectively from four storage tanks to the photoconductor;

developing the photoconductor with each of the four inks which are supplied by the supplying;

measuring a toner concentration of each of the inks to be supplied to the photoconductor by the supplying;

measuring an amount of each of the four inks included respectively in the storage tanks;

controlling the toner concentration of each of the four inks stored respectively in the storage tanks and the amount of each of the four inks, by supplementing each of the storage tanks with a concentrated ink an a carrier, and by discharging an excessive ink from each of the storage tanks, while developing the photoconductor by the developing, based on the measurement value measured by the measuring the toner concentration and the measurement amount measured by the measuring the amount.

The controlling may include:

sequentially storing the measurement values which are measured by the measuring the toner concentration and the measurement values which are measured by the measuring the amount;

obtaining a change rate, with respect to a predetermined time period, of each of the measurement values sequentially stored by the storing;

discriminating an ink having a highest change rate among the change rates of other inks, based on combinations of the respective change rates of the toner concentrations and the respective change rates of the amounts of the inks which are stored in the respective storage tanks; and controlling the toner concentration of the discriminated ink and the amount of the discriminated ink.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Preferred embodiments of the present invention will now be explained with reference to the accompanying drawings.

First Embodiment

Figure 1:
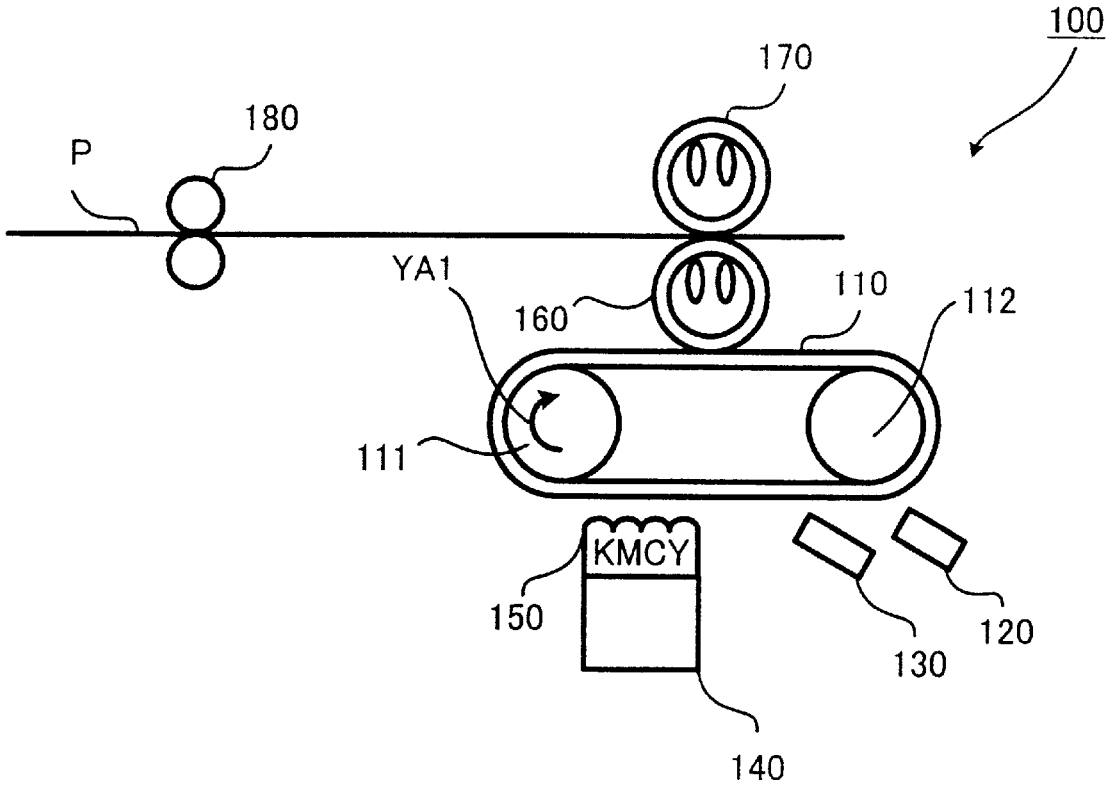
FIG. 1 is a diagram showing the structure of a printer according to the first embodiment of the present invention.

FIG. 1 shows the structure of a printer 100 according to the first embodiment of the present invention.

The printer 100 prints images using a wet-type electrophotographic printer. The printer 100 develops an electrostatic latent image formed on a photoconductor belt with an ink, and transfers an image formed with a toner onto a paper P.

The ink is composed of a solid toner and a liquid carrier. In this specification, the concentration of the ink is to represent the weight percentage of the toner included in the ink.

The printer 100 comprises a photoconductor belt 110, a charger 120, an exposure device 130, a liquid developing device 140, a developing unit 150, a transfer roller 160, a fixation roller 170, and a discharge roller 180.

The photoconductor belt 110 is an endless belt, and driven by a driving roller 111. The photoconductor belt 110 is supported by a steering roller 112, and rotated in a clockwise direction, as shown with an arrow YA1.

The charger 120 charges the surface of the photoconductor belt 110 with electricity. The exposure device 130 radiates, for example, a laser beam onto a charged section of the photoconductor belt 110, so as to form an electrostatic latent image.

The liquid developing device 140 keeps the concentration and amount of four colors of inks, Yellow (Y), Magenta (M), Cyan (C), Black (K), to predetermined levels, respectively. The developing unit 150 adheres each ink from the liquid developing device 140 to the charged section of the photoconductor belt 110. The toner included in the ink is adhered to the photoconductor belt 110, whereby to form an image corresponding to the electrostatic latent image.

The transfer roller 160 is rotated in synchronization with the rotational movement of the photoconductor belt 110. Hence, the toner on the photoconductor belt 110 is transferred onto the surface of the transfer roller 160, and further transferred onto the paper P. The fixation roller 170 is rotated in contact with the transfer roller 160, between which the paper P is sandwiched and the toner transferred onto the transfer roller 160 melts. The melted toner is fixed onto the paper P. The discharge roller 180 discharges the paper P.

Figure 2:
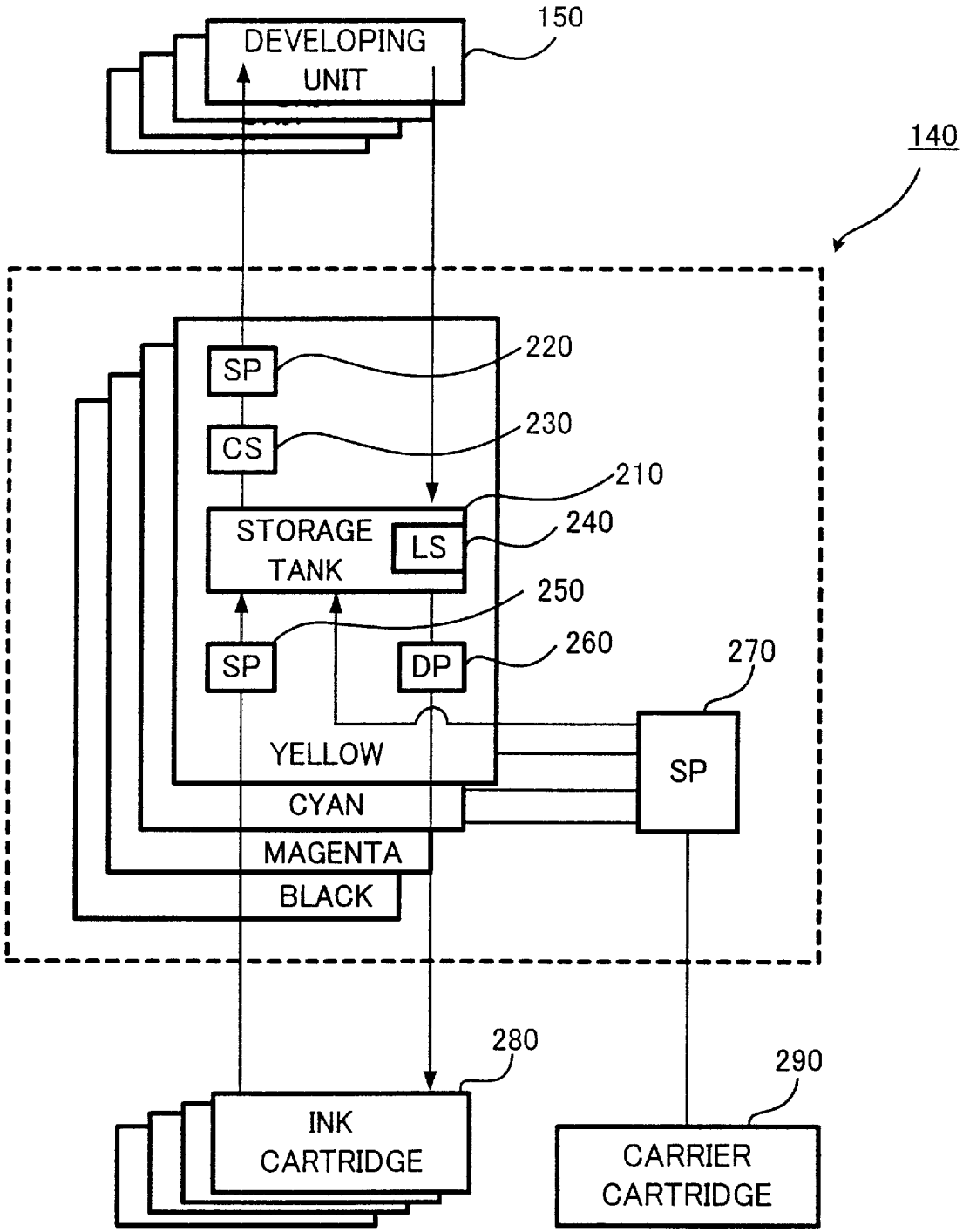
FIG. 2 is a block diagram showing the structure of a liquid developing device.

FIG. 2 is a block diagram showing the structure of the liquid developing device 140.

The liquid developing device 140 includes an ink circulation path and an ink adjustment path. The ink circulation path is prepared for circulating the ink toward the developing unit 150. The ink adjustment path is prepared for adjusting the concentration and amount of stored ink, and retaining the respective concentration and amount at a predetermined level.

The liquid developing device 140 comprises four storage tanks 210 corresponding respectively to the four colors of inks, an ink supply pump 220, a concentration sensor 230, a liquid level sensor 240, a concentrated-ink supply pump 250, an ink discharge pump 260, and a carrier supply pump 270.

Four ink cartridge 280 and a carrier cartridge 290 are fitted to the liquid developing device 140. Each of the ink cartridges 280 stores concentrated ink (whose concentration is higher than the concentration of generally-used ink). The ink cartridges 280 have a space for receiving ink discharged from their corresponding storage tanks 210. The carrier cartridge 290 stores carrier.

Figure 3:
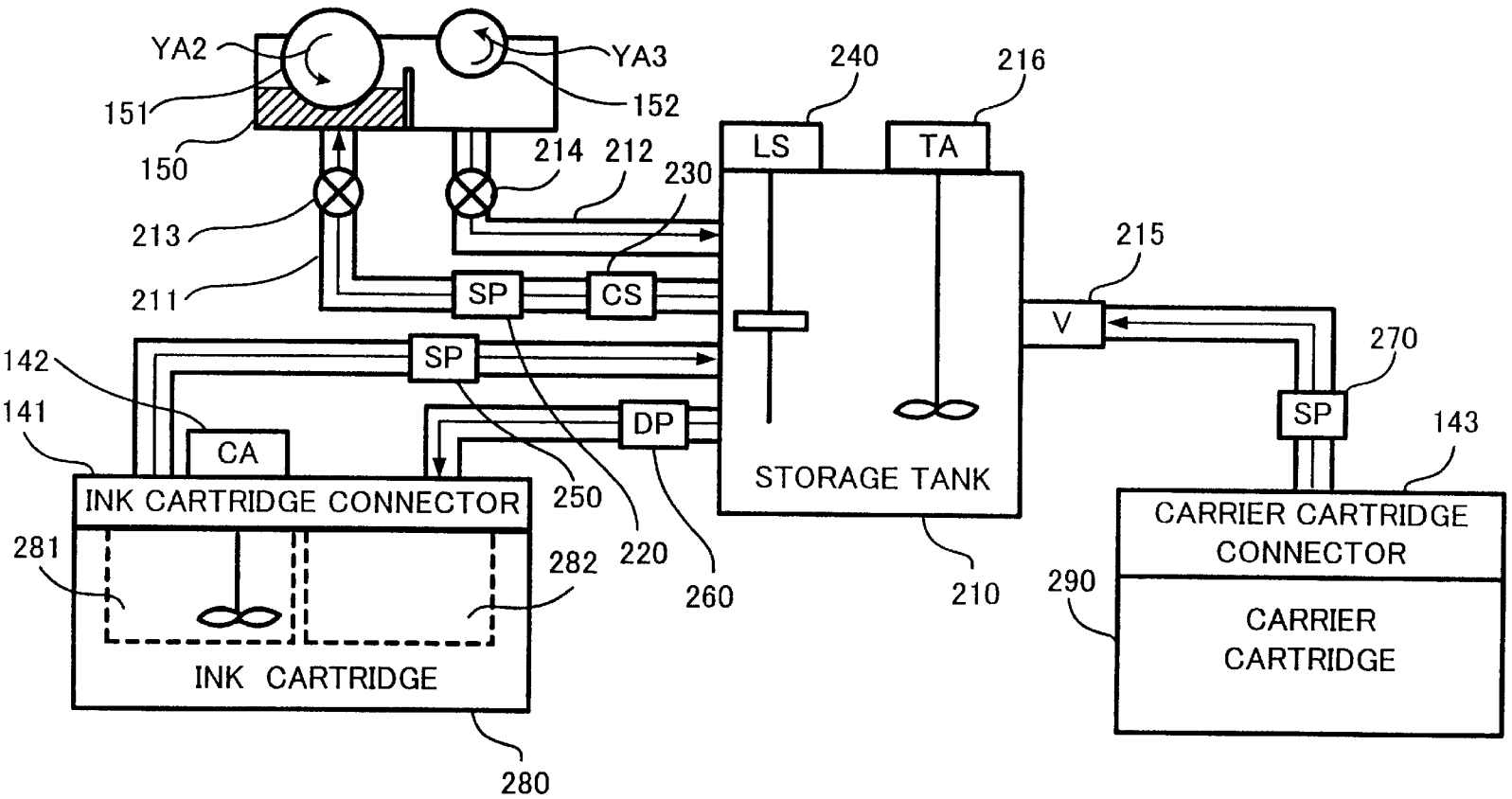
FIG. 3 is a diagram showing a part of the structure of the liquid developing device.

For the sake of clear explanations, illustrated in FIG. 3 is the structure of the liquid developing device 140 in the case of developing single-color images.

The storage tank 210 stores ink. The ink stored in the storage tank 210 is sent by the ink supply pump 220 to the developing unit 150 through the ink supply tube 211. The ink is returned back to the storage tank 210 through an ink collection tube 212, after being used in the developing unit 150.

The ink supply tube 211 and the ink collection tube 212 includes a circulation valves 213 and 214, respectively. The circulation valves 213 and 214 are opened and closed under the control of a controller 300. Particularly, the circulation valves 213 and 214 are closed except when printing is performed. When printing is performed, the ink which is absorbed by the ink supply pump 220 circulates between the storage tank 210 and the developing unit 150.

The developing unit 150 is arranged upward of the storage tank 210, and includes a developing roller 151 and a squeeze roller 152.

The developing roller 151 is rotated in a counter-clockwise direction as shown with an arrow YA2 in FIG. 3. The developing roller 151 is in contact with the photoconductor belt 110, and adheres ink thereto. The squeeze roller 152 is rotated in a counter-clockwise direction as shown with an arrow YA3 in FIG. 3. The squeeze roller 152 is in contact with the photoconductor belt 110, and removes excessive ink therefrom. The removed ink is collected to the storage tank 210 through the ink collection tube 212.

The storage tank 210 is connected to the ink cartridge 280, receives concentrated ink sent from the ink cartridge 280, and discharges ink to the ink cartridge 280.

The ink cartridge 280 is attachable to and detachable from an ink cartridge connector 141, and includes two storage section 281 and 282. The storage section 281 stores concentrated ink. The storage section 282 stores ink discharged from the storage tank 210. Connected to the ink cartridge connector 141 is a cartridge agitator 142, and agitates the concentrated ink stored in the ink cartridge 280.

The storage tank 210 is connected to the carrier cartridge 290 through a carrier supply valve 215, and accepts carrier sent from the carrier cartridge 290. The carrier cartridge 290 is attachable to and detachable from a carrier cartridge connector 143, and stores carrier.

The concentrated-ink supply pump 250 supplies the storage tank 210 with concentrated ink from the ink cartridge 280. The ink discharge pump 260 discharges the ink stored in the storage tank 210 to the ink cartridge 280. The carrier pump 270 supplies the storage tank 210 with carrier from the carrier cartridge 290.

The concentration sensor 230 is prepared on the ink supply tube 211 in a position between the circulation valve 213 and the storage tank 210. The concentration sensor 230 measures the concentration of the toner included in the ink which is supplied from the storage tank 210 to the developing unit 150. The concentration sensor 230 sends a measured result to the controller 300.

The liquid level sensor 240 measures a liquid level of the ink stored in the storage tank 210, so as to estimate the amount of the ink, and sends a measured result to the controller 300.

A tank agitator 216 agitates the ink in the storage tank 210 at predetermined cycles, so that the toner included in the ink is prevented from being deposited thereinside or that the deposited toner is scattered around.

Figure 4:
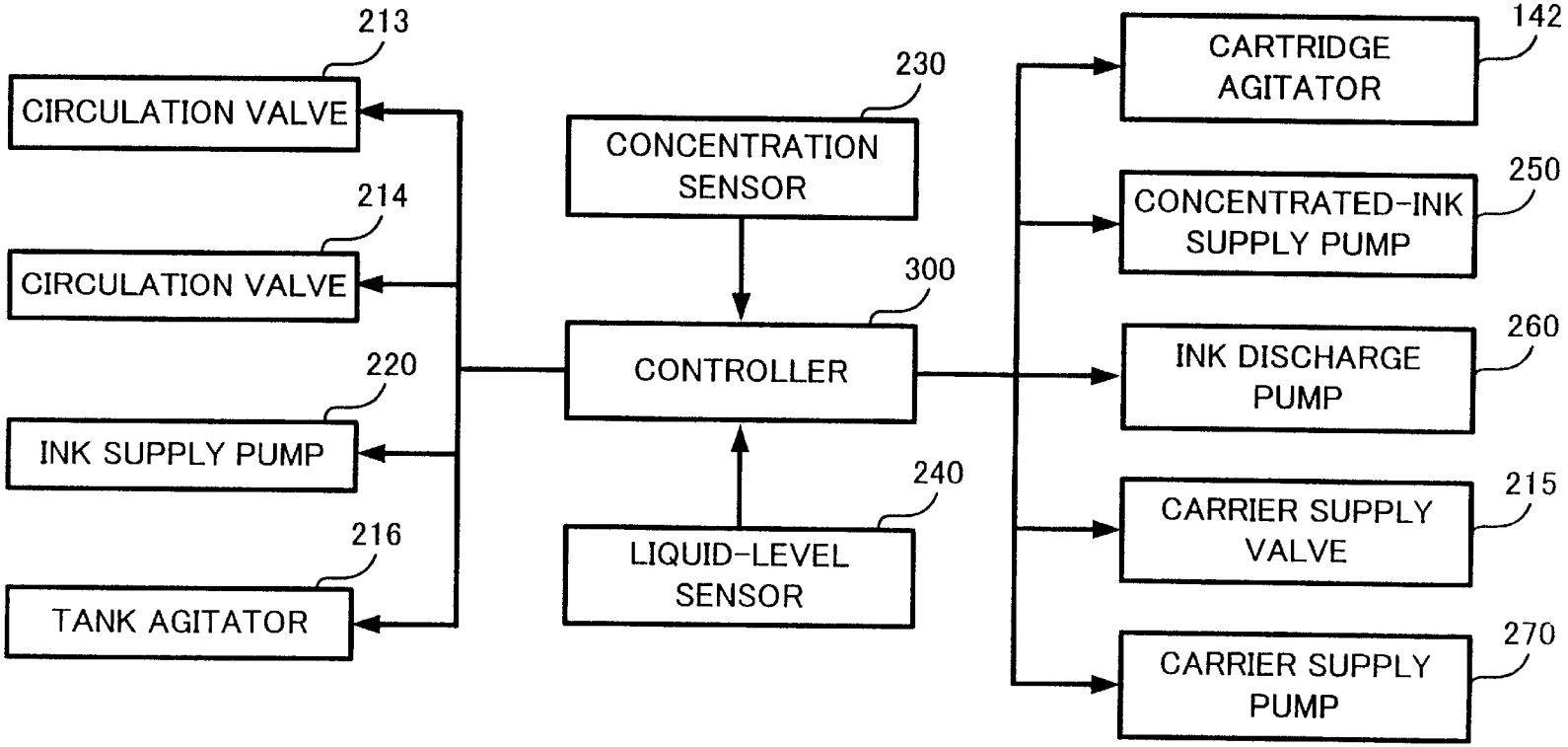
FIG. 4 is a diagram for explaining a controller included in the liquid developing device.

As shown in FIG. 4, the controller 300 is connected to various sensors, pumps, and valves. The controller 300 controls operations of the pumps and valves, based on an output from each sensor, as will be explained later. The controller 300 retains the concentration and amount of the ink for use in developing images to a predetermined level.

The printer 100 shown in FIG. 1 forms images as described below. The photoconductor belt 110 is rotated in a clockwise direction, as shown with an arrow YA1 in FIG. 1. The charger 120 charges the photoconductor belt 110 with electricity. The exposure device 130 radiates a laser beam onto the charged section of the photoconductor belt 110, so as to form an electrostatic latent image on the photoconductor belt 110.

The liquid developing device 140 adjusts the concentration and liquid level of the stored ink, and sends the ink to the developing unit 150. The developing unit 150 adheres the ink sent from the liquid developing device 140 onto the surface of the photoconductor belt 110. Toner included in the ink is attracted onto the photoconductor belt 110 by static electricity, travels inside the carrier, and adheres to the charged section of the photoconductor belt 110. Hence, the toner is distributed in a manner corresponding to the electrostatic latent image on the photoconductor belt 110. The distributed toner on the photoconductor belt 110 is fixed onto the transfer roller 160. Then, the toner is melted by the fixation roller 170, and is transferred onto the paper P, so as to form an image thereon.

The ink sent from the liquid developing device 140 to the developing unit 150 circulates therebetween, as described below. The ink cartridge 280 is installed into the ink cartridge connector 141, whereas the carrier cartridge 290 is installed into the carrier cartridge connector 143. Ink including toner whose weight percentage ranges from 2 to 4 is stored in the storage tank 210. When the concentration of the ink is adjusted in this range, the printer 100 outputs an image having desired concentration of toner onto the paper P.

Under the control of the controller 300, the circulation valves 213 and 214 are opened, and the tank agitator 216 and the ink supply pump 220 are operated. The ink supply pump 220 is operated all the time during a printing operation, and supplies the developing unit 150 with the ink stored in the storage tank 210. The tank agitator 216 agitates the ink stored in the storage tank 210 at predetermined intervals.

After this, the developing unit 150 adheres the ink sent from the ink supply pump 220 onto the photoconductor belt 110. The toner included in the ink adhered onto the photoconductor belt 110 travels inside the carrier, and is further adhered onto the charged section of the photoconductor belt 110. Any excessive ink drops by gravitation through the ink collection tube 212, and returns to the storage tank 210. In this way, the ink circulates between the storage tank 210 and the developing unit 150. Because some toner has been used in printing the image, the concentration of the ink in the storage tank 210 is lower than the initial concentration of the ink in the initial state.

After the ink circulates between the storage tank 210 and the developing unit 150, the concentration and liquid level of the ink stored in the storage tank changes. The concentration sensor 230 measures the concentration of the ink sent from the storage tank 210 to the developing unit 150, and outputs a measured result to the controller 300. The liquid level sensor 240 measures the liquid level of the ink stored in the storage tank 210, and outputs a measured result to the controller 300.

Based on the output results from the concentration sensor 230 and liquid level sensor 240, the controller 300 controls operations of the concentrated-ink supply pump 250, the ink discharge pump 260 and carrier pump 270, as described below.

When detected that the concentration of the supplied ink is higher than a predetermined level of concentration by the concentration sensor 230, the controller 300 activates the carrier pump 270. The carrier pump 270 supplies the storage tank 210 with carrier from carrier cartridge 290.

When detected that the concentration of the supplied ink is lower than a predetermined level of concentration by the concentration sensor 230, the controller 300 activates the concentrated-ink supply pump 250. The concentrated-ink supply pump 250 supplies the storage tank 210 with concentrated ink from the ink cartridge 280.

When detected that the liquid level of the supplied ink is higher than a predetermined liquid level by the liquid level sensor 240, the controller 300 activates the ink discharge pump 260. The ink discharge pump 260 discharges the ink stored in the storage tank 210 to the ink cartridge 280.

When detected that the liquid level of the supplied ink is lower than a predetermined liquid level by the liquid level sensor 240, the controller 300 activates the concentrated-ink supply pump 250 and the carrier pump 270. The concentrated-ink supply pump 250 and the carrier pump 270 supply the storage tank 210 with the concentrated ink and carrier which are at a predetermined ratio to each other.

Figure 5:
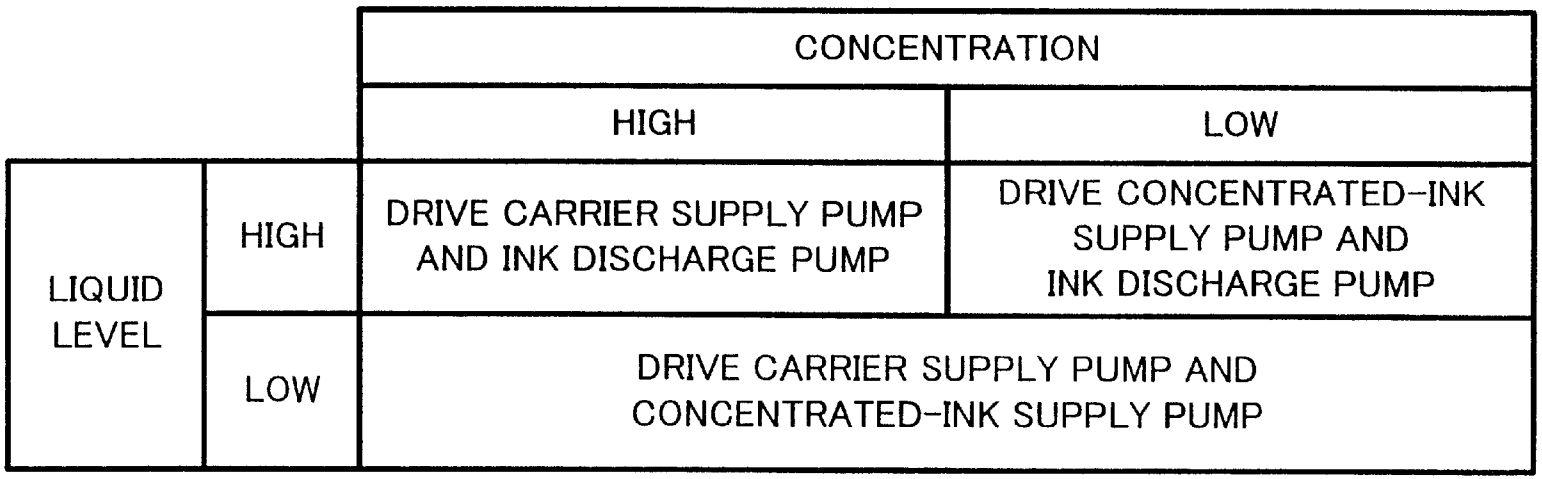
FIG. 5 is a diagram for explaining an ink adjustment technique.

FIG. 5 shows an operation which is performed based on outputs from the concentration sensor 230 and the liquid level sensor 240. The concentration and amount of ink stored in the storage tank 210 are retained at a predetermined by the execution of the operation shown in FIG. 5.

Just before completion of a developing operation, the controller 300 makes sure that the concentration and amount of the ink stored in the storage tank 210 are at a predetermined level, based on the output values of the concentration sensor 230 and the liquid level sensor 240, so as to be ready for the next developing operation. After this, the controller 300 suspends the operations of the concentrated-ink pump 250, the ink discharge pump 260, the carrier supply pump 270, and the ink supply pump 220. After this, the controller 300 controls the circulation valves 213 and 214 to be closed, thus completing the current developing operation.

The above explanations have been made relative to the operation of the liquid developing device when printing is performed using a single color of ink. In the case where printing is performed using four colors of inks, in the liquid developing device 140, the four colors of inks stored in the storage tank 210 are used sequentially from that arranged in an upstream position of the rotational direction of the photoconductor belt 110. In order of (Y), (C), (M), and (K), the concentration and amount of the four colors of inks are adjusted at a constant time interval of, for example, 10 seconds. The carrier supply valve 215 prepared adjacent each storage tank 210 is opened and closed under the control of the controller 300.

According to the structure of the printer of this embodiment, because the ink circulation path and the ink adjustment path are separately prepared, the concentration of the ink can desirably be adjusted during the developing operation, without interfering with each other. Since variation of the concentration and amount of the ink stored in the storage tank can be set lower and reduced, desired images can successively be output.

Second Embodiment

The printer 100 according to the first embodiment of the present invention, may possibly output an image including a particular color ink of a very-low concentration, when the printing density of the color ink is high and no processing can not performed for adjusting the concentration before printing is completed.

If an arithmetic logic unit whose processing rate is high is included in the controller 300, it can speedily adjust the concentration of ink. However, such an arithmetic logic unit is quite expensive, resulting in a high cost developing device.

Explanations will now be made of a printer, which can print images using color inks whose concentrations are not low and can be manufactured reasonably at a low cost, according to the second embodiment of the present invention.

Figure 6:
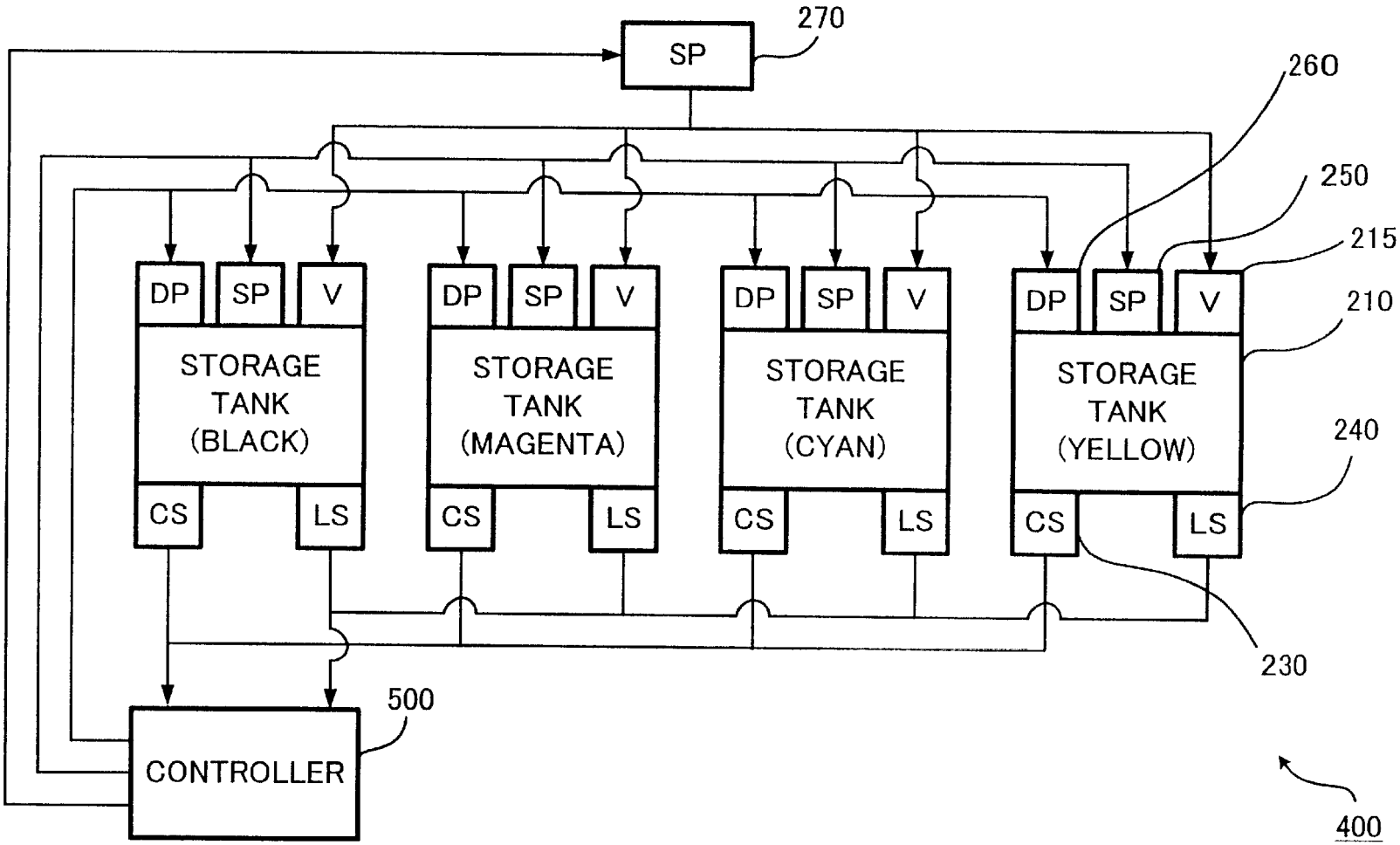
FIG. 6 is a diagram showing the structure of a printer according to the second embodiment of the present invention.

FIG. 6 is a diagram showing the structure of a printer according to the second embodiment of the present invention.

A printer 400 of the second embodiment has substantially the same structure of the printer according to the first embodiment, except the structure of the controller included in the liquid developing device.

A controller 500 of the printer 400 stores a record of the output values of the concentration sensor 230 and the liquid-level sensor 240 in association with each color ink.

Based on the record of the output values, the controller 500 calculates a decreasing rate of past two points for each of the four color inks.

The controller 500 discriminates particular color inks corresponding to an output value whose decreasing rate from the previous measured output value is the highest among any other output values. In accordance with this discrimination, the controller 500 adjusts the concentration of ink sequentially from the discriminated color ink, in order of higher decreasing rate.

As described above, the controller 500 calculates the decreasing rate of the output values of the concentration sensor 230 and the liquid-level sensor 240 by referring to the measured past or prior two points. However, this calculation may be performed based on past three points or more.

As explained above, the printer of this embodiment calculates the decreasing rate of the concentration and liquid level of ink based on past measured values. Then, the printer adjusts the concentration of ink, from the one which is discriminated to be of the lowest concentration. In this structure, the printer can stably print images each having a plurality of colors with similar concentrations. This prevents unevenness of color toners in printed images.

The controller of the printer obtains only the decreasing rate of the output values of the concentration sensor and the liquid level sensor, so as to change the order in which concentrations of the respective color toners are adjusted. Hence, no complicated arithmetic operation is required to be performed by the controller. The controller can be formed using a low cost arithmetic logic unit. Therefore, the printer can stably perform successive printing operations at a low cost.

In the above explanations, the controller 300 compares the measurement values from the concentration sensor 230 with a predetermined value and also the measurement values from the liquid-level sensor 240 with a predetermined value. In accordance with whether each measurement value is higher or lower than the predetermined value, the controller 300 drives the concentrated-ink supply pump 250, the ink discharge pump 260, and the carrier pump 270.

The present invention is not limited to this method. The concentration and amount of the ink can be retained respectively at predetermined levels using any other methods. For example, the controller 300 may drive each of the concentrated-ink supply pump 250, the carrier supply pump 270, the ink discharge pump 260, based on an error between a value measured by the concentration sensor 230 and a target value of the concentration and an error between a measurement amount from the liquid level sensor 240 and a target value of the liquid level of the ink.

In this case, the controller 300 drives each pump for supplying the concentrated ink or carrier to the storage tank 210, in accordance with the error, between the measurement value output from the concentration sensor 230 and the target value, and an integrated result of the error, and a differentiated result of the error, under the control of a PID (proportional Integration and Differential) control program stored therein.

When the amount of ink stored in the storage tank 21 is not sufficient, the controller 300 drives each of the pumps for supplying a predetermined amount of liquid to the storage tank 21, in accordance with an error between the measurement value from the level sensor 240 and the target value, a integrated result of the error, and a differentiated result of the error. Similarly, when there is an excessive amount of ink stored in the storage tank 210, the controller 300 drives the ink discharge pump for discharging the ink from the storage tank 210. Having performed this, the controller 300 approaches the toner concentration and amount of the ink stored in the storage tank 210 to a target value of the concentration and a target value of the liquid level.

The present invention is not limited to the above embodiments, and various embodiments and changes may be made thereonto without departing from the broad spirit and scope of the invention. In the above embodiments, the liquid level of the ink is measured so as to estimate the amount of ink stored in the storage tank. However, the weight of the ink can be measured. The explanations have been made to the ink cartridge as one for storing the concentrated ink and accepting the excessive ink. However, the liquid developing device may include another cartridge only for accepting the excessive ink. The explanations have been made to the device for developing the electrostatic latent image on the photoconductor belt. However, it is not limited to the photoconductor belt, and any other belt, which can retain an electrostatic latent image with static electricity by being charged with electricity, can be employed. The explanations have been made to the exposure device which radiates a laser beam so as to form an electrostatic latent image. However, any other LED (Light Emitting Diode) exposure system can be employed.

The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2000-074785 filed on Mar. 16, 2000, and including specification, claims, drawings and summary. The disclosure of the above Japanese Patent Application is incorporated herein by reference in its entirety.

What is claimed is:

1. A liquid developing device comprising:

a storage tank which stores an ink, including a toner and a carrier, for developing an electrostatic latent image formed on a photoconductor;

an ink supply pump which sends an ink from said storage tank to the photoconductor;

a concentration sensor which measures a toner concentration of the ink to be sent to the photoconductor;

a storage-amount sensor which measures an amount of ink stored in said storage tank;

a concentrated-ink supply pump which sends a concentrated ink from an ink cartridge for storing an concentrated ink to said storage tank;

a carrier supply pump which sends a carrier from a carrier cartridge for storing a carrier to said storage tank;

an ink discharge pump which discharges excessive ink from said storage tank to a discharge cartridge; and a controller which includes a control mode that simultaneously controls and drives said concentrated-ink supply pump, said carrier supply pump, and said ink discharge pump, so as to maintain a predetermined level of the toner concentration of the ink stored in said storage tank and a predetermined amount of the ink, based on a measurement value from said concentration sensor and a measurement amount from said storage-amount sensor; wherein said controller supplements said storage tank with a concentrated ink using said concentrated-ink supply pump, supplements said storage tank with a carrier using said carrier supply pump, and discharges an excessive ink from said storage tank using said ink discharge pump, based on an error between a measurement value from said concentration sensor and a predetermined value of the concentration and an error between a measurement amount from said storage-amount sensor and a predetermined amount, so that the toner concentration of the ink stored in said storage tank and the amount of the ink approach the predetermined value of the concentration and the predetermined amount, respectively.

2. The liquid developing device according to claim 1, wherein said controller drives each of said concentrated-ink supply pump, said carrier supply pump, said ink discharge pump, so as to supply a concentrated ink or a carrier to said storage tank, in accordance with at least one of the error between the measurement value from said concentration sensor and the predetermined value of the toner concentration, an integrated result of the error, and a differentiated result of the error, and to supply a concentrated ink and a carrier to said storage tank or to discharge an excessive ink from said storage tank, in accordance with at least one of the error between the measurement amount from said level sensor and the predetermined amount, an integrated result of the error, and a differentiated result of the error.

3. A liquid developing device comprising:

four storage tanks which respectively store four colors, yellow, cyan, magenta, and black, of inks, each including a toner and a carrier, for use in developing an electrostatic latent image formed on a photoconductor;

four ink supply pumps which respectively send the four colors of inks from the respective storage tanks;

four concentration sensors which respectively measure toner concentrations of the respective four colors of inks to be sent to said photoconductor;

four storage-amount sensors which respectively measure amounts of four colors of inks stored in the respective storage tanks;

four concentrated-ink supply pumps which respectively send four colors of inks from ink cartridges to the respective storage tanks each of which stores a same color of ink as a color of a concentrated ink stored in one of four ink cartridges;

a carrier supply pump which sends a carrier to the storage tanks from a carrier cartridge storing a carrier;

four ink discharge pumps which respectively discharge excessive inks from the respective storage tanks to a discharge cartridge; and a controller which includes a control mode that simultaneously controls and drives each of said concentrated-ink supply pumps, said carrier supply pump, and said ink discharge pumps, so as to maintain a predetermined level of the toner concentrations of the inks stored in the respective storage tanks and a predetermined amount of the inks stored therein, based on a measurement value from each of said concentration sensors and a measurement amount of each of said storage-amount sensors; and wherein said controller sequentially stores measurement values measured by said respective concentration sensors and measurement amounts measured by said respective storage-amount sensors, and obtains a change rate of each of the respective measurement values and change rates of the respective measurement amounts, with respect to a predetermined time period;

discriminates an ink having a highest change rate among the change rates of other inks, based on combinations of the respective change rates of the toner concentrations and the respective change rates of the amounts of the inks which are stored in the respective storage tanks; and controls the toner concentration of the discriminated ink and the amount of the discriminated ink.

4. A liquid developing device comprising:

a storage tank which stores an ink, including a toner and a carrier, for developing an electrostatic latent image formed on a photoconductor;

an ink supply pump which sends an ink from said storage tank to the photoconductor;

a concentration sensor which measures a toner concentration of the ink to be sent to the photoconductor;

a storage-amount sensor which measures an amount of ink stored in said storage tank;

a concentrated-ink supply pump which sends a concentrated ink from an ink cartridge for storing an concentrated ink to said storage tank;

a carrier supply pump which sends a carrier from a carrier cartridge for storing a carrier to said storage tank;

an ink discharge pump which discharges excessive ink from said storage tank to a discharge cartridge;

a controller which includes a control mode that simultaneously controls and drives said concentrated-ink supply pump, said carrier supply pump, and said ink discharge pump, so as to maintain a predetermined level of the toner concentration of the ink stored in said storage tank and a predetermined amount of the ink, based on a measurement value from said concentration sensor and a measurement amount from said storage-amount sensor; and a photoconductor which is rotated by being driven by a driving roller;

a charger which charges said photoconductor with electricity;

an exposure device exposes said charged photoconductor to form an electostatic latent image on said photoconductor;

a developing unit to which an ink is supplied from said liquid developing device, and which adheres the supplied ink onto a section of said photoconductor which is charged with electricity and on which the electrostatic latent image is formed;

a transfer roller which is rotated in synchronization with said photoconductor, and onto whose surface a toner on said photoconductor is transferred so as to transfer the toner onto a recording medium;

a fixation roller which is rotated in contact with said transfer roller between which the recording medium is sandwiched, melts the toner transferred onto the transfer roller, and fixes the melted toner onto the recording medium; and a discharge roller which discharges the recording medium onto which the toner is fixed by said fixation roller.

5. A liquid developing method comprising:

supplying ink from a storage tank, storing an ink including a toner and a carrier and for use in developing an electrostatic latent image formed on a photoconductor, to said photoconductor;

developing said photoconductor with the ink supplied by said supplying;

measuring a toner concentration of the ink which is to be sent to said photoconductor by said supplying;

measuring an amount of ink stored in said storage tank; and controlling the toner concentration of the ink stored in said storage tank and the amount of the ink, by selectively simultaneously supplying said storage tank with a concentrated ink and with a carrier, and discharging an excessive ink from said storage tank, while developing the photoconductor by said developing, based on a measurement value measured by said measuring the toner concentration and a measurement amount measured by said measuring the amount; and wherein said controlling includes supplying a concentrated ink to said storage tank, supplying a carrier to said storage tank, and discharging an excessive ink from said storage tank, based on an error between the measurement value and a predetermined value of a toner concentration and an error between the measurement amount and a predetermined amount of ink, so as to approach the toner concentration of the ink stored in said storage tank and the amount of the stored ink to the predetermined value and the predetermined amount, respectively.

6. The liquid developing method according to claim 5, wherein said controlling includes supplying a concentrated ink to said storage tank, supplying a carrier to said storage tank, and discharging an excessive ink from said storage tank, so as to supply said storage tank with an amount of an ink or carrier, in accordance with at least one of the error between the measurement value and the predetermined value of the toner concentration, an integrated result of the error, and a differentiated result of the error, and to supply to or discharge from said storage tank an amount of a liquid, in accordance with at least one of an error between the measurement amount and the predetermined amount of the ink, an integrated result of the error, and a differentiated result of the error.

7. A liquid developing method comprising:

supplying four kinds of inks, each of which includes a toner and a carrier, for use in developing an electrostatic latent image formed on a photoconductor, respectively from four storage tanks to the photoconductor;

developing the photoconductor with each of the four inks which are supplied by said supplying;

measuring a toner concentration of each of the inks to be supplied to the photoconductor by said supplying;

measuring an amount of each of the four inks included respectively in the storage tanks;

controlling the toner concentration of each of the four inks stored respectively in the storage tanks and the amount of each of the four inks, by supplementing each of the storage tanks with a concentrated ink and a carrier, and by discharging an excessive ink from each of the storage tanks, while developing the photoconductor by said developing, based on the measurement value measured by said measuring the toner concentration and the measurement amount measured by said measuring the amount;

wherein said controlling step includes:

sequentially storing the measurement values which are measured by said measuring the toner concentration and the measurement values which are measured by said measuring the amount;

obtaining a change rate, with respect to a predetermined time period, of each of the measurement values sequentially stored by said storing;

discriminating an ink having a highest change rate among the change rates of other inks, based on combinations of the respective change rates of the toner concentrations and the respective change rates of the amounts of the inks which are stored in the respective storage tanks; and controlling the toner concentration of the discriminated ink and the amount of the discriminated ink.

* * * * *